US010106755B2

(12) United States Patent
Horst

(10) Patent No.: US 10,106,755 B2
(45) Date of Patent: Oct. 23, 2018

(54) ELECTROMAGNETICALLY MODIFIED ETHANOL

(71) Applicant: THE FUEL MATRIX, LLC, Henderson, NV (US)

(72) Inventor: Thomas R. Horst, Henderson, NV (US)

( * ) Notice: Subject to any disclaimer, the term of this patent is extended or adjusted under 35 U.S.C. 154(b) by 0 days.

(21) Appl. No.: 15/230,894

(22) Filed: Aug. 8, 2016

(65) Prior Publication Data

US 2018/0037832 A1 Feb. 8, 2018

(51) Int. Cl.

| | |
|---|---|
| ***C10L 1/182*** | (2006.01) |
| ***C10L 10/00*** | (2006.01) |
| ***C10L 1/12*** | (2006.01) |

(52) U.S. Cl.

CPC ..... *C10L 1/1824* (2013.01); *C10L 1/125* (2013.01); *C10L 10/00* (2013.01); *C10L 2290/24* (2013.01); *C10L 2290/36* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,386,938 | A | 6/1983 | Earle | |
| 4,599,088 | A | 7/1986 | Davis | |
| 4,668,245 | A | 5/1987 | Schieler | |
| 5,628,805 | A | 5/1997 | Lif | |
| 5,723,138 | A | 3/1998 | Bae | |
| 5,871,625 | A | 2/1999 | Leddy | |
| 6,193,987 | B1 | 2/2001 | Harbeck | |
| 6,482,243 | B2 | 11/2002 | Podlipskiy | |
| 7,172,635 | B2 | 2/2007 | Bongardt | |
| 2014/0227548 | A1* | 8/2014 | Myrick | C06B 45/30 428/570 |
| 2017/0170477 | A1* | 6/2017 | Sakshaug | H01M 4/587 |

* cited by examiner

*Primary Examiner* — Ellen M McAvoy
*Assistant Examiner* — Chantel L Graham
(74) *Attorney, Agent, or Firm* — Nydegger & Associates

(57) ABSTRACT

The present invention is a fuel additive that includes adducts which have been formed in a solution of metallic ions, ethanol and water. In particular, the adducts are formed for the fuel additive when the solution is electromagnetically radiated. When formed, the adducts have relatively strong permanent dipoles that will influence the temporary dipoles of hydrocarbons in untreated fuel. Specifically, under the influence of the fuel additive, hydrocarbons in the treated fuel will exhibit permanent dipoles that more effectively interact with oxygen molecules from air when the treated fuel is atomized in air in a combustion chamber.

18 Claims, 1 Drawing Sheet

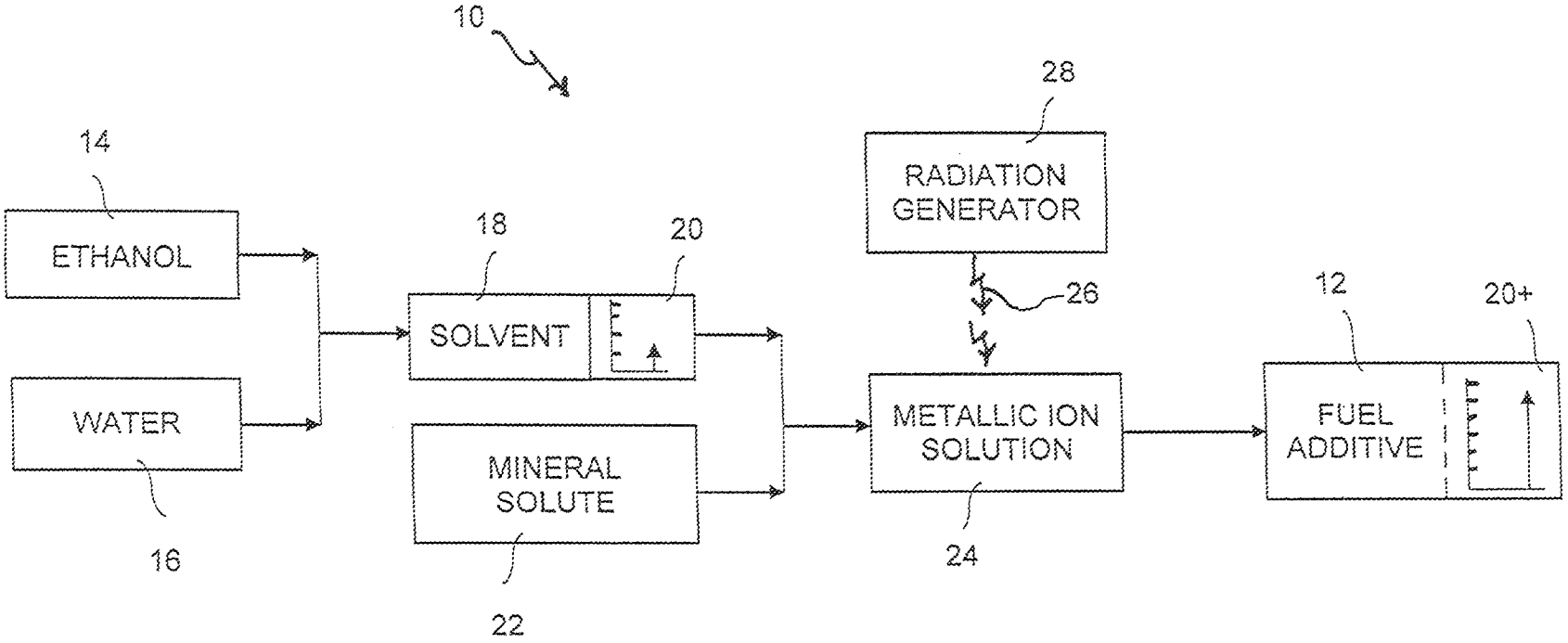
10
14
ETHANOL
WATER
16
18
SOLVENT
20
MINERAL SOLUTE
22
28
RADIATION GENERATOR
26
METALLIC ION SOLUTION
24
12
FUEL ADDITIVE
20+

ELECTROMAGNETICALLY MODIFIED ETHANOL

FIELD OF THE INVENTION

The present invention pertains generally to liquid additives that enhance the characteristics of another liquid in which it is dissolved. More particularly, the present invention pertains to additives that include adducts which influence the electromagnetic characteristics of molecules in a liquid, hydrocarbon based fuel. The present invention is particularly, but not exclusively, useful as an additive that influences the temporary dipoles of hydrocarbons in fuel to become permanent dipoles, and thereby improve the combustion characteristics of the fuel by increasing the bonding of the fuel with oxygen from the air.

BACKGROUND OF THE INVENTION

At the molecular level, atoms combine with each other to create molecules that will exhibit varying degrees of electromagnetic properties. For instance, some molecules have relatively strong dipoles, which means that the molecule exhibits a relatively high electric potential between two oppositely charged points (poles) on the molecule. On the other hand, other molecules can have relatively weak dipoles. In either instance, the strong or the weak dipoles of a molecule may be permanent. It also happens, however, that some molecules do not have permanent dipoles and, instead, have what are known as instantaneous or temporary dipoles.

As an electrical consideration, the dipole of a molecule is a measure of the forces that affect the molecule's attraction or repulsion for other molecules. More particularly, these forces manifest themselves as intermolecular forces (IMFs), which are forces that hold molecules together. These forces also manifest themselves as dispersion forces (i.e. London forces), which separate and scatter molecules. With the above in mind, the present invention exploits the fact that an alteration of the permanent dipole of a molecule will alter its IMFs and dispersion forces vis-à-vis other molecules.

Of particular importance for the present invention are complexes of molecules that are generally referred to as adducts. Adducts are chemical compounds which form an unbonded association between its constituent components. In detail, adducts are the product of directly adding two or more molecules together in a reaction product (i.e. an inclusion complex) that contains all of the atoms of the constituent components. In their association with each other, the molecules of one component in an adduct are contained within a shell of the other component.

As envisioned for the present invention, the fuel additive that is created is intended for use in combustion engines. Specifically, the fuel additive is particularly suitable for uses as disclosed in U.S. patent application Ser. No. 15/231,002 for an invention entitled "A Homogeneous Solution of a Treated Fuel and Oxygen from the Air for use in a Combustion Chamber," which was filed concurrently with the present application and which is incorporated herein by reference.

With the above in mind, it is an object of the present invention to provide a fuel additive that includes adducts which are created by electromagnetically radiating a solution of a mineral solute and an ethanol-water solvent, wherein the resultant solution includes adducts having stronger permanent dipoles than did components of the ethanol-water solvent prior to radiation. Another object of the present invention is to provide a fuel additive that improves the combustion efficiency of a fuel that has been treated with the additive. Yet another object of the present invention is to provide a fuel additive that is easy to manufacture, is simple to use, and is comparatively cost effective.

SUMMARY OF THE INVENTION

A fuel additive in accordance with the present invention is a liquid solution containing modified ethanol together with other chemicals. For the present invention, the first step in creating this modified ethanol requires dissolving a mineral solute containing metallic ions having a permanent charge in an ethanol water solvent which has permanent, moderate-strength, dipoles. The resultant metallic ion solution is then radiated with an electromagnetic wave.

During the electromagnetic radiation of the metallic ion solution, adducts are created. Structurally, each of the created adducts is a complex that includes an unbonded association of molecules. In this case, charged particles of the metallic ion are contained in a shell of ethanol and water. The consequence here is that the adducts (i.e. modified ethanol) have a permanent dipole with a relatively strong polarity. Importantly, the permanent dipole of the adducts is stronger than the permanent dipoles which were present in the metallic ion solution prior to radiation.

As intended for the present invention, when the modified ethanol described above is dissolved in a fuel and used as a fuel additive, the stronger permanent dipoles of the adducts in the additive will influence and change both the dispersion forces and the intermolecular forces (IMFs) of hydrocarbons in the treated fuel. As a result, when the treated fuel is atomized in a combustion chamber, the treated fuel is able to dissolve higher concentrations of oxygen from the air and thereby provide a more efficient fuel combustion.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

The FIGURE is a schematic representation of the process required for making a fuel additive in accordance with the present invention.

DESCRIPTION OF THE PREFERRED EMBODIMENTS

Referring to the FIGURE, a process in accordance with the present invention is schematically shown and is generally designated 10. As indicated in the FIGURE, the process 10 for making a fuel additive 12 begins by dissolving ethanol 14 and water 16 to create an ethanol-water solvent 18 that contains molecules having a permanent dipole 20. The solvent 18 is then pre-blended with a mineral solute 22 to create a homogeneous metallic ion solution 24.

As envisioned for the present invention the ethanol-water solvent 18 will preferably be pre-blended with a percentage of water 16 to ethanol 14 that is in a range between 2% and 7%. The FIGURE indicates that the ethanol-water solvent 18 will include molecules which have a permanent dipole 20. On the other hand, the mineral solute 22 which is to be dissolved into the ethanol-water solvent 18 will itself be a water solution of hydrated metallic ions having a permanent charge. For the present invention, the mineral solute 22 that is pre-blended with the ethanol-water solvent 18 to create the metallic ion solution 24 will preferably include ions of potassium, aluminum, boron, or iron.

An important aspect of the present invention is that the homogeneous metallic ion solution 24, which includes the ethanol-water solvent 18 and the mineral solute 22, is radiated with an electromagnetic wave 26. In detail, the electromagnetic wave 26 is generated by a radiation generator 28, with the electromagnetic wave 26 having predetermined operational parameters. These parameters include a predetermined wavelength λ, a predetermined energy E, and a predetermined time duration Δt. Further, the electromagnetic wave 26 may be either uni-directionally or multi-directionally radiated into the metallic ion solution 24, and it may be generated continuously, or it may be pulsed.

For purposes of the present invention, the operational parameters of the electromagnetic wave 26 will be as follows. The wavelength λ of the electromagnetic wave 26 will in a range between $10^{-7}$ m and $10^{-8}$ m. The energy E, of the electromagnetic wave 26 will be in a range between 150 kJ/mol and 300 kJ/mol. And, the metallic ion solution 24 will be radiated for a time duration Δt, between one and two hours. As noted above, the electromagnetic wave 26 may be pulsed. If so, the pulses (not shown) can each have a pulse duration and an interval between pulses that are predetermined by requirements of the process 10.

As intended for the process 10 of the present invention, the purpose for radiating the metallic ion solution 24 with the electromagnetic wave 26 is to create adducts in the homogeneous metallic ion solution 24. Specifically, the adducts that are formed by this radiation are inclusion complexes containing charged particles from the mineral solute 22 (i.e. metallic ions), and the ethanol 14, as well as water 16. The result is the fuel additive 12 in which ethanol 14 in the solvent 18 has been modified for inclusion in the adducts (i.e. a "modified" ethanol 14). Importantly, the "modified" ethanol 14 is homogeneous and will have a relatively stronger permanent dipole $\mathbf{20}^+$. In particular, as envisioned for the present invention, the permanent dipoles $\mathbf{20}^+$ of the fuel additive 12 will experience a change in polarity from a range between 1 Debye and 1.5 Debye to a range between 2 Debye and 2.5 Debye. In any event, the dipole $\mathbf{20}^+$ will have a polarity that is greater than a corresponding dipole 20 of ethanol molecules of the pre-blended ethanol-water solvent 18, prior to a radiation of the metallic ion solution 24.

While the particular Electromagnetically Modified Ethanol as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A fuel additive which comprises:

a solution of ethanol and water wherein the ethanol-water solution is a percentage of water to ethanol in a range between 2% and 7%; and a mineral solution containing metallic ions, wherein the ethanol-water solution and the mineral solution are pre-blended together to form a metallic ion solution, and wherein the metallic ion solution is radiated with an electromagnetic wave having predetermined operational parameters to create the fuel additive with adducts, wherein each adduct in the fuel additive has a relatively stronger permanent dipole than do corresponding molecules of the pre-blended ethanol-water solution prior to radiation.

2. The fuel additive recited in claim 1 wherein the permanent dipoles of the adducts have a predetermined change in polarity from a range between 1 Debye and 1.5 Debye to a range between 2 Debye and 2.5 Debye.

3. The fuel additive recited in claim 1 wherein the electromagnetic wave radiation has a predetermined wavelength λ, a predetermined energy E, and a predetermined time duration Δt.

4. The fuel additive recited in claim 3 wherein the predetermined wavelength λ is in a range between $10^{-7}$ m and $10^{-8}$ m.

5. The fuel additive recited in claim 3 wherein the predetermined energy E is in a range between 150 kJ/mol and 300 kJ/mol.

6. The fuel additive recited in claim 3 wherein the metallic ion solution is radiated for a time duration Δt between one and two hours.

7. The fuel additive recited in claim 3 wherein the electromagnetic radiation is uni-directionally radiated into the metallic ion solution.

8. The fuel additive recited in claim 1 wherein the mineral solution contains metallic ions selected from the group consisting of potassium, aluminum, boron, and iron.

9. An additive for interaction with hydrocarbons in a fuel, wherein the hydrocarbons have temporary dipoles, and wherein the additive comprises adducts, wherein the adducts are each an inclusion complex containing charged particles of a metallic ion and molecules in a shell of ethanol and water with each adduct having a permanent dipole for influencing the temporary dipoles of the hydrocarbons into permanent dipoles for an improved combustion efficiency of the influenced hydrocarbons.

10. The additive recited in claim 9 wherein the metallic ion is selected from the group consisting of potassium, aluminum, boron, and iron.

11. The additive recited in claim 9 wherein the adducts are formed in a blended solution of a mineral solution and a solution of ethanol and water, when the pre-blended solution is radiated with a predetermined electromagnetic wave.

12. The additive recited in claim 11 wherein the electromagnetic wave radiation has a predetermined wavelength λ, a predetermined energy E, and a predetermined time duration Δt.

13. The additive recited in claim 9 wherein the ethanol-water solution is a percentage of water to ethanol in a range between 2% and 7%.

14. A method for making a fuel additive which comprises the steps of:

preparing a solution of ethanol and water;

blending the ethanol-water solution with a mineral solution to create a metallic ion solution; and radiating the metallic ion solution with an electromagnetic wave to create adducts therein, wherein each adduct is an inclusion complex including a charged particle of a metallic ion in a shell of ethanol and water, and the adduct provides a permanent dipole with a predetermined polarity in a range between 2 Debye and 2.5 Debye for the fuel additive.

15. The method for making a fuel additive as recited in claim 14 wherein the ethanol-water solution is a percentage of water to ethanol in a range between 2% and 7%.

16. The method for making a fuel additive as recited in claim 15 wherein the permanent dipole of the adduct has a stronger dipole than do corresponding molecules in the metallic ion solution.

17. The method for making a fuel additive as recited in claim 14 wherein the electromagnetic wave radiation has a predetermined wavelength $\lambda$, a predetermined energy E, and a predetermined time duration $\Delta t$.

18. The method for making a fuel additive as recited in claim 14 wherein the metallic ion is selected from the group consisting of potassium, aluminum, boron, and iron, and wherein the metallic ion is pre-blended with the ethanol-water solution, when the metallic ion is in a mineral solution.

* * * * *